United States Patent [19]

Tsuchikawa et al.

[11] Patent Number: 4,505,641

[45] Date of Patent: Mar. 19, 1985

[54] COOLING FAN FOR INTERNAL COMBUSTION ENGINE

[75] Inventors: Shunzo Tsuchikawa, Ichinomiya; Masaharu Hayashi; Takanobu Hori, both of Toyota, all of Japan

[73] Assignee: Aisin Seiki Kabushiki Kaisha, Kariya, Japan

[21] Appl. No.: 564,361

[22] Filed: Dec. 22, 1983

Related U.S. Application Data

[63] Continuation of Ser. No. 240,904, Mar. 5, 1981, abandoned.

[30] Foreign Application Priority Data

Mar. 7, 1980 [JP] Japan ..... 55-30082[U]

[51] Int. Cl.[3] ..... F04D 29/38

[52] U.S. Cl. ..... 416/189; 416/192; 415/172 A

[58] Field of Search ..... 416/189, 192, 195, 238, 416/228 R; 123/41.11, 41.49; 415/172 RA

[56] References Cited

U.S. PATENT DOCUMENTS

| | | | |
|---|---|---|---|
| 855,131 | 5/1907 | Preidel | 416/189 R X |
| 1,919,250 | 11/1931 | Olson | 416/238 |
| 1,929,690 | 10/1933 | Huntman | 416/238 |
| 2,370,652 | 6/1939 | Frisbie | 416/238 |
| 2,754,919 | 7/1956 | Blue | 416/238 |
| 2,972,382 | 2/1961 | Manzolillo | 416/238 |
| 3,842,902 | 10/1974 | Poslusny | 415/170 R |
| 4,135,858 | 1/1979 | Entat | 416/238 X |
| 4,329,946 | 5/1982 | Longhouse | 123/41.49 |

FOREIGN PATENT DOCUMENTS

| | | | |
|---|---|---|---|
| 1178215 | 5/1959 | France | 416/228 |
| 51915 | 4/1980 | Japan | 123/41.49 |

*Primary Examiner*—Everette A. Powell, Jr.

*Attorney, Agent, or Firm*—Oblon, Fisher, Spivak, McClelland & Maier

[57] ABSTRACT

A cooling fan to be located between an internal combustion engine and a radiator and rotatingly driven from a rotational shaft of the engine. The fan includes a plurality of blade elements radially projecting from a boss portion and a cylindrical ring formed at the outer ends of the blade elements coaxially with the boss portion. In each blade element, a base line, which is drawn through a base point located on a chord of blade between leading and trailing edges of the blade element at a distance of 40% from the leading edge in percentage to the length of the chord, describes a straight or moderately curved line from the inner to the outer end of the blade element, which is inclined rotationally forward of a radial line passing through the base point at the inner end of the blade element. This fan construction produces air flows containing axial and radial components of velocity to increase the air flows through the radiator irrespective of the existence of the internal combustion engine on the downstream side of the fan. Maximum air flow is obtained by projecting the trailing edge of the outer end of each blade element from the trailing edge of the above-mentioned ring by a length corresponding to $\frac{1}{3}$ of the chord length of the outer blade end.

2 Claims, 5 Drawing Figures

COOLING FAN FOR INTERNAL COMBUSTION ENGINE

This application is a continuation of application Ser. No. 240,904, filed Mar. 5, 1981, abandoned.

BACKGROUND OF THE INVENTION

1. Field of the Invention

This invention relates to a fan located between an internal combustion engine and a radiator and rotatingly driven from a rotational shaft of the engine.

2. Description of the Prior Art

In a liquid cooled internal combustion engine, a cooling liquid is circulated through jackets in the cylinder block and cylinder head of the engine and, after being led out of the internal combustion engine, passed through a radiator to exchange heat with air flows from a fan which is provided in association with pipes and fins of the radiator. After being cooled, the liquid is recirculated to the jackets of the internal combustion engine. Normally, the cooling fan is rotatingly driven from a rotational shaft of the engine. With regard to the relation between the fan and radiator, it is the usual practice to provide an axial flow type fan which has its rotational face located close to the radiator and is driven by a rotational shaft which is positioned parallel with the air passages in the radiator. Namely, the fan is in most cases located between a radiator and an internal combustion engine, positioning the radiator on the suction (upstream) side of the fan in consideration of the cooling effects on the radiator of the air flows produced by the axial flow type cooling fan.

With such an arrangement, the internal combustion engine is located in a position close to the discharge (downstream) side of the cooling fan, so that the air flows which are formed by the fan impinge upon the internal combustion engine, producing a back pressure which reduces the air flow to be generated by the cooling fan. Such a reduction of air flow is generally prevented by forming behind the radiator a shroud which has an inner diameter slightly larger than the diameter of the fan, regulating the air flows uniform on the suction (upstream) side of the fan by rotating same at the rear edge portion of the shroud. In this case, however, the air flows on the discharge (downstream) side of the fan diverge radially outward upon impingement on the engine which constitutes a resisting body, forming reverse flows at the end portions of the fan blades as indicated by arrows of chain line A in FIG. 1. These reverse air flows form vortices around the end portions of the fan blades within the shroud, further lowering the air flow rate.

SUMMARY OF THE INVENTION

With the foregoing in view, the present invention has as its object the provision of a fan for a radiator of an internal combustion engine, in which the air flows suctioned by the rotation of the fan in the direction of rotational axis thereof are diverted away from the rotational axis on the discharge side of the fan, as indicated by arrows of solid line B in FIG. 1, thereby dissipating the reverse air flows as at chain line arrows A irrespective of the existence of a resisting body downstream of the fan to increase the air flow rate through the cooling system of the engine.

According to the present invention, there is provided a cooling fan located in association with a radiator of an internal combustion engine and having a plurality of radially extending blade elements around a center boss for passing cooling air through the radiator, the fan including a cylindrical ring member provided coaxially with the rotational axis of the fan and connecting outer ends of the blade elements, a base line connecting base points in airfoil sections of each one of the blade elements describing a straight or moderately curved line from the inner to the outer end of the blade element in a plane of rotation thereof and being inclined rotationally forward of a radial line passing through a base point at the inner end of the blade element and the base line also describing a straight or moderately curved line from the inner to the outer end of the blade element in a plane containing the rotational axis of the blade element and inclined toward the suction side from the plane of rotation of the blade element.

Suitably, the aforementioned ring is secured to the front edges (leading edges) of the fan blade ends, and maximum air flow of the fan is obtained when the rear edge (trailing edges) of the blade ends are protruded from the end edge of the ring by $\frac{1}{3}$ the length of the width of the blade ends in a projection perpendicular to the rotational axis of the fan.

Further, the reverse air flows of the prior art as indicated by arrows A can be dissipated by diverging the end portion on the suction side of the ring radially outward of the fan with a bend at its marginal edge toward the discharge side thereof. In this instance, reverse air flows are completely dispelled by the use of a ring with a diverging portion the maximum diameter of which is greater than the minimum inner diameter of the shroud.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts through the several views and wherein.

DETAILED DESCRIPTION OF THE PREFERRED EMBODIMENTS

Figure 1:
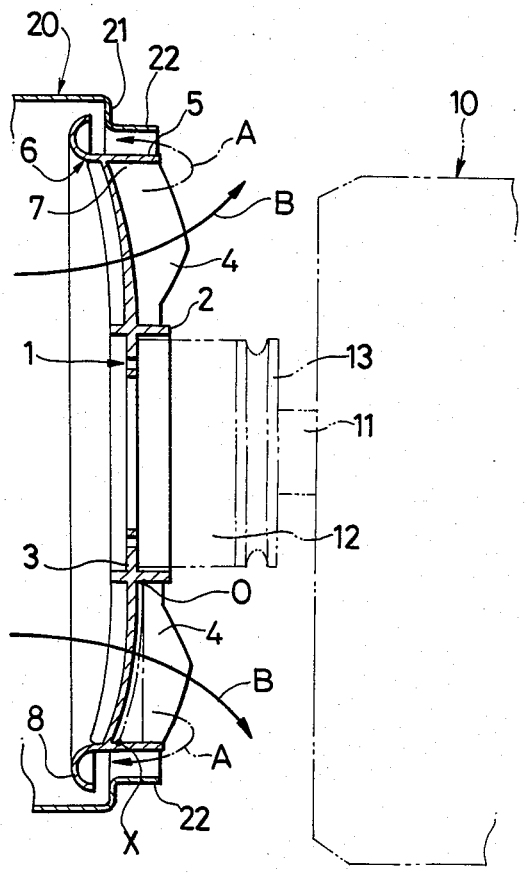
FIG. 1 is a diagrammatic sectional view of a first embodiment of the present invention.
Figure 2:
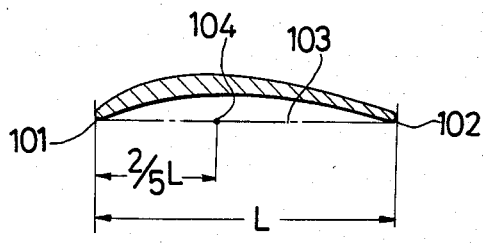
FIG. 2 is a diagrammatic sectional view of a blade element.
Figure 3:
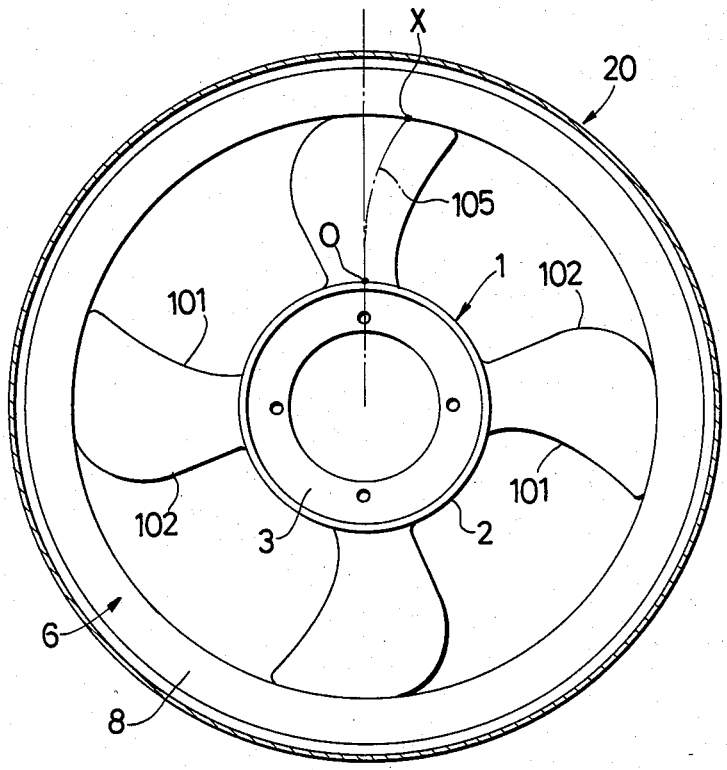
FIG. 3 is a front view of the fan.

Referring to FIGS. 1 to 3 which show an embodiment of the present invention, a fan 1 is supported and rotatingly driven by an internal combustion engine 10, within an opening defined by a rear edge of a shroud 20 which is provided behind a radiator (not shown).

The fan 1 is centrally provided with a boss portion 3 which is surrounded by a cylindrical flange 2 and provided with a number of blade elements 4 integrally on the outer periphery thereof. The fan 1 is normally connected through the flange 2 to a joint 12 which is rotatably supported on a fixed shaft 11 on a cylinder block of the internal combustion engine 10 and which is connected to a pulley 13 which is in turn rotationally connected to an output shaft (not shown) of the engine.

Secured to the end portions of the blade elements 4 of the fan 1 is a ring 6 which is provided with a cylindrical portion 5 coaxially with the rotational axis of the boss portion 3 thereby integrally connecting the blade elements 4.

Each blade element 4 of the fan 1 is in the form of an airfoil as shown in FIG. 2 in section at an arbitrary radius from the center of rotation thereof. A base line 105 of the blade element 4 which is drawn through a base point 104 on a chord between a front edge (leading edge) 101 and a rear edge (trailing edge) 102 of airfoil section, at 2/5 of the length of the chord from the leading edge, describes a straight line or a moderate curve from a base point O at the base end of the blade to a base point X at the outer blade end within the plane of rotation of the blade element 4, the base line 105 being inclined rotationally forward of a radial line passing through the base point O at the base end of the blade element 4 and at the same time toward the suction side of the fan 1 from a plane of rotation passing through the base point O at the base end of the blade element 4 within a plane containing the rotational axis of the blade element 4 (fan 1).

Upon rotating the fan 1 thus constructed, the air flows downstream of the blade elements 4, with components of velocity perpendicular to the rotational axis of the fan 1 as indicated by arrow B in FIG. 1 owing to the inclination of the base line 105 of the blade elements 4, are diverged obliquely from the center axis of the fan 1, so that there is no possibility of increasing the back pressure even in the presence of a large resistance like the internal combustion engine on the downstream side of the fan 1. Therefore, air is passed through the radiator in a sufficient quantity to ensure its cooling effect.

Further, the end portion of the ring 6 on the suction side may diverge radially outward with the marginal edge of the diverged end portion reversed toward the discharge side of the ring 6 to form an arcuately curved flange 8 which serves to block the reverse air flows occurring at the outer ends of the blade elements 4 as indicated by chain line arrows A, thereby preventing degradation of the efficiency of the fan 1.

The efficiency of the fan 1 is improved all the more by complete dissipation of the reverse air flows indicated by arrows A, in a case where a ring 8 with the arcuate flange 8 is used in combination with a shroud 20 which is provided with a stepped portion 21 in the end portion 22 on the discharge side thereof, forming an opening of a reduced diameter which is smaller than the outer diameter of the arcuate flange 8 of the ring 6.

Figure 4:
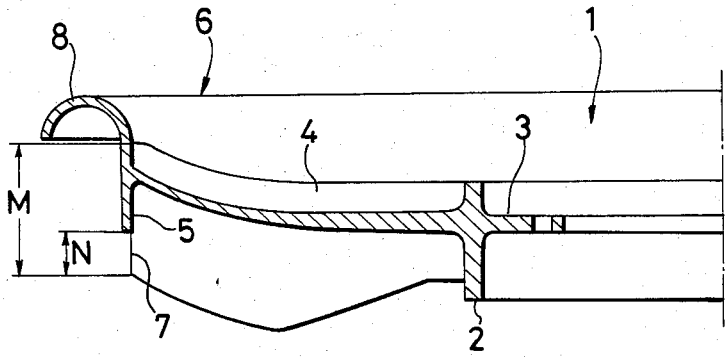
FIG. 4 is a diagrammatic sectional view of a second embodiment of the present invention.

FIG. 4 illustrates another embodiment of the present invention, in which the outer end portion 7 of each blade element 4 is secured to the ring 6 on the side of the front edge (leading edge) thereof over a length corresponding to $\frac{1}{3}$ to $\frac{3}{4}$ of the width M the outer end 7 of the blade element 4 as projected on the rotational axis of the fan 1, the remainder N of the outer blade end 7 protruding from the edge on the discharge side of the ring 6. The air flows on the discharge side (downstream) of the fan 1 diverge more desirably by freely projecting the rear edge portion of the outer blade end 7 over a length N corresponding to $\frac{1}{4}$ to $\frac{2}{3}$ of the outer blade end 7, increasing the quantity of air flow through the radiator. According to the results of expertiments, the quantity of air flows becomes maximum when N is $\frac{1}{3}$M.

Figure 5:
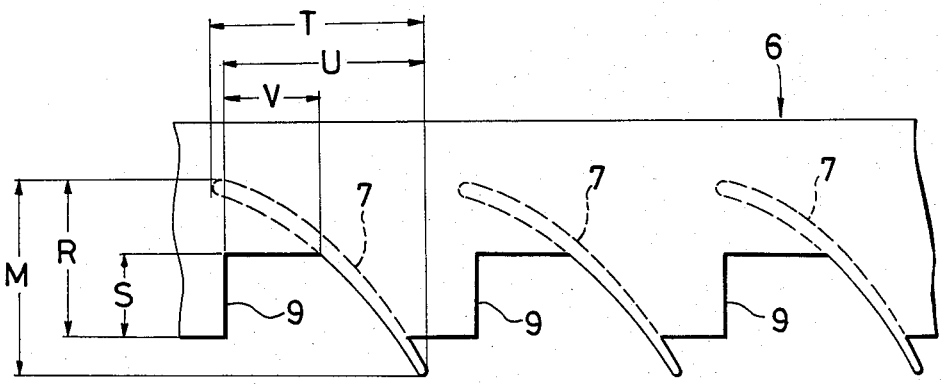
FIG. 5 is a developed view of a ring in another embodiment of the invention.

Referring now to FIG. 5, there is shown in a developed view a ring 6 in a further embodiment of the present invention, in which the ring 6 is provided with notches 9 along the edge on the discharge side, each notch 9 having a length of S on the side away from the blade elements 4 and a length of V in the direction along the circumference of the ring 6, the remaining side of the notch 9 being cut along the concave side of the blade element 4. The provision of these notches 9 gives an effect as if the lower faces of the outer blade ends are protruded on the discharge side of the ring 6 although the actual degree of protrusion is very small, contributing to an increase in the air flow by augmenting the diverging air flows of arrows B and at the same time to reduce the weight of the fan 1. It is preferred to determine the above-mentioned lengths S and V in the ranges of the following table, relative to the width M of the outer blade end 7 as projected on the rotational axis of the fan 1, the dimension R from the front edge of the outer blade end 7 to the rear edge of the ring 6, the width T of the outer blade end 7 as projected in the circumferential direction of the ring 6, and the dimension U between the axial side of the notch 9 and the rear edge of the outer blade end 7, shown in FIG. 5.

TABLE

| R | S | U | T |
|---|---|---|---|
| 0.4 M–1.1 M | 0.3 M–0.7 M | 0.5 T–1.0 T | 0.05 T–0.7 T |
| $R > (R - S)$ | | $U > (U - V)$ | |

As is clear from the foregoing description, due to the inclination of the base line of the blade elements, the air flows downstream of the fan contain components of velocity diverging radially outward from the axis of rotation so that the back pressure of the fan is not increased even if a body which resists the air flows like an internal combustion engine exists on the discharge side of the fan. In addition, the fan construction of the invention prevents reverse air flow which otherwise occurs around the rear edge of the ring in the conventional axis fans, thus improving the efficiency of the fan to guarantee increased air flow through the radiator.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A cooling fan located in association with a radiator of an internal combustion engine and having a plurality of radially extending blade elements around a boss portion for passing cooling air through said radiator, said fan comprising:

a cylindrical ring member provided coaxially with the rotational axis of the fan and connecting outer end portions of said blade elements; and a base line connecting base points in airfoil sections of each of said blade elements on chords thereof located between a leading edge and a trailing edge of the airfoil section at a point 2/5ths the length of each chord from the leading edge so as to describe a moderately curved line from the inner to the outer end of said blade elements in a plane of rotation thereof and being inclined rotationally forward of a radial line passing through a base point at the inner end of said blade elements;

said base line describing a moderately curved line from the inner to the outer end of said blade elements in a plane containing the rotational axis of said blade elements and inclined toward a suction side from said plane of rotation of said blade elements;

a leading edge portion of the outer end of each of said blade elements being secured to said ring over a length corresponding to $\frac{1}{3}$ to $\frac{3}{4}$ of the width of said outer blade end as projected perpendicularly to the rotational axis of the fan, a remainder of the outer blade end forming a free end portion, and the trailing edges of said blade elements projecting on the discharge side of said ring and the end portion on the suction side of said ring diverging radially outward and then bending toward a discharge side of the fan.

2. A cooling fan as set forth in claim 1, wherein said ring includes notches formed therein along the rear edge thereof at positions adjoining fixed portions of said blade elements.

* * * * *